US008052458B2

(12) United States Patent
Rossman et al.

(10) Patent No.: US 8,052,458 B2
(45) Date of Patent: Nov. 8, 2011

(54) ELECTRICAL CONNECTOR ASSEMBLY

(75) Inventors: Jared Evan Rossman, Dover, PA (US); Steven Lee Flickinger, Hummelstown, PA (US); John Eugene Westman, Harrisburg, PA (US); Karen Paul Seubert, Camp Hill, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 75 days.

(21) Appl. No.: 12/566,878

(22) Filed: Sep. 25, 2009

(65) Prior Publication Data

US 2011/0076889 A1 Mar. 31, 2011

(51) Int. Cl.
*H01R 13/648* (2006.01)

(52) U.S. Cl. ..... 439/358

(58) Field of Classification Search ..... 439/358, 439/350, 357, 488, 352, 353, 680
See application file for complete search history.

(56) References Cited

U.S. PATENT DOCUMENTS

| | | | | |
|---|---|---|---|---|
| 4,449,767 | A | 5/1984 | Weidler | |
| 5,147,226 | A | 9/1992 | Kile | |
| 5,213,534 | A | 5/1993 | Gardner et al. | |
| 5,595,509 | A | 1/1997 | Fry et al. | |
| 6,022,246 | A | 2/2000 | Ko | |
| 6,116,938 | A | 9/2000 | Myer et al. | |
| 6,146,190 | A | 11/2000 | Fuerst et al. | |
| 6,290,527 | B1 * | 9/2001 | Takaya et al. | 439/352 |
| 6,827,609 | B1 | 12/2004 | Martin et al. | |
| 6,857,892 | B2 | 2/2005 | McLauchlan et al. | |
| D509,321 | S * | 9/2005 | Gray | D28/46 |
| 6,953,285 | B2 | 10/2005 | Mickievicz | |
| 6,964,579 | B2 | 11/2005 | Seminara et al. | |
| 7,063,578 | B2 | 6/2006 | Goto | |
| 7,189,005 | B2 | 3/2007 | Ward | |
| 7,217,161 | B1 | 5/2007 | Tyler et al. | |
| 7,303,447 | B1 | 12/2007 | Tyler | |
| 7,419,399 | B2 | 9/2008 | Yosler | |
| 7,462,067 | B1 * | 12/2008 | Whiteman et al. | 439/562 |
| 7,465,185 | B2 | 12/2008 | Tyler | |
| 7,481,664 | B1 * | 1/2009 | Knoll et al. | 439/359 |
| 2008/0311781 | A1 * | 12/2008 | Wojcik et al. | 439/352 |

FOREIGN PATENT DOCUMENTS

| | | |
|---|---|---|
| CN | 2 399 851 | 10/2000 |
| EP | 0 104 755 | 4/1984 |

OTHER PUBLICATIONS

European Search Report, International Application No. EP 10 17 7606.

* cited by examiner

*Primary Examiner* — Tulsidas Patel
*Assistant Examiner* — Phuong Nguyen

(57) ABSTRACT

An electrical connector assembly includes a housing having a base and contact towers extending forward from the base. The base has an outer perimeter defined between a front and a rear of the base, and the base has a latch extending forward from the base generally parallel to and spaced apart from the towers such that a gap is defined between a bottom of the latch and a top of the towers. Flanges extend upward from the top of the towers and at least partially block the gap. Contacts are held by the housing, where the contacts extend into the contact towers for mating with mating contacts of a mating connector.

19 Claims, 5 Drawing Sheets

ELECTRICAL CONNECTOR ASSEMBLY

BACKGROUND OF THE INVENTION

The subject matter herein relates generally to electrical connector assemblies, and more particularly, to electrical connector assemblies having mating features.

Electrical connector assemblies typically include mating halves that are mated together. Electrical connector assemblies are used in a variety of industries and applications, such as in the appliance industry in a refrigerator. Other examples include in the automotive industry, the machinery industry, cabling networks, and the like. The mating halves are typically terminated to ends of cables and include contacts that are mated together to make an electrical connection between the mating halves.

One problem with known connector assemblies is difficulty in mating the mating halves and/or damage to the various components during mating. For example, the contacts may be damaged if the mating halves are not properly aligned during mating. Additionally, in some applications, it may be difficult for the user to make the connection as the connector assembly may be positioned in an area that is difficult to reach or see the mating halves during mating. It is also difficult to grip the connector assemblies during mating and unmating.

Another problem with known connector assemblies is that the latches that are provided on one or both connector halves may be snagged by the wires that are associated with the connector assemblies. For example, during shipping of the cabled assemblies, the wires may wrap around or get snagged underneath the latch. When handling the connector assemblies, pulling on the wires may cause the latch to bend and/or break.

An electrical connector assembly is needed that overcomes these and other problems. An electrical connector assembly is needed that may be assembled in a convenient manner. An electrical connector assembly is needed that reduces or eliminates the problems associated with wire snag of the latch.

BRIEF DESCRIPTION OF THE INVENTION

In one embodiment, an electrical connector assembly is provided that includes a housing having a base and contact towers extending forward from the base. The base has an outer perimeter defined between a front and a rear of the base, and the base has a latch extending forward from the base generally parallel to and spaced apart from the towers such that a gap is defined between a bottom of the latch and a top of the towers. Flanges extend upward from the top of the towers and at least partially block the gap. Contacts are held by the housing, where the contacts extend into the contact towers for mating with mating contacts of a mating connector.

In another embodiment, an electrical connector assembly is provided that includes a housing having a base and contact towers extending forward from the base. The base has an outer perimeter defined between a front and a rear of the base, and the base has a latch extending forward from the base for latching engagement with a mating connector. The base has a first finger grip and a second finger grip. The first finger grip is tapered in a forward direction and the second finger grip is tapered in a rearward direction. Contacts are held by the housing, where the contacts extend into the contact towers for mating with mating contacts of the mating connector.

In a further embodiment, an electrical connector assembly is provided including a plug connector and a mating connector. The plug connector includes a housing having a base and contact towers extending forward from the base. The base receives contacts therein that extend at least partially into the contact towers. The base has an outer perimeter defined between a front and a rear of the base, and the base has a latch extending forward from the base. The latch is recessed with respect to the outer perimeter of the base. The mating connector includes a housing having contact chambers extending between a front and a rear of the housing. The chambers receive mating contacts therein and the chambers receives the contact towers of the plug connector such that the mating contacts engage the contacts of the plug connector. The housing has a latch cavity receiving the latch of the plug connector such that the latch is contained within the housing of the mating connector.

DETAILED DESCRIPTION OF THE INVENTION

Figure 1:
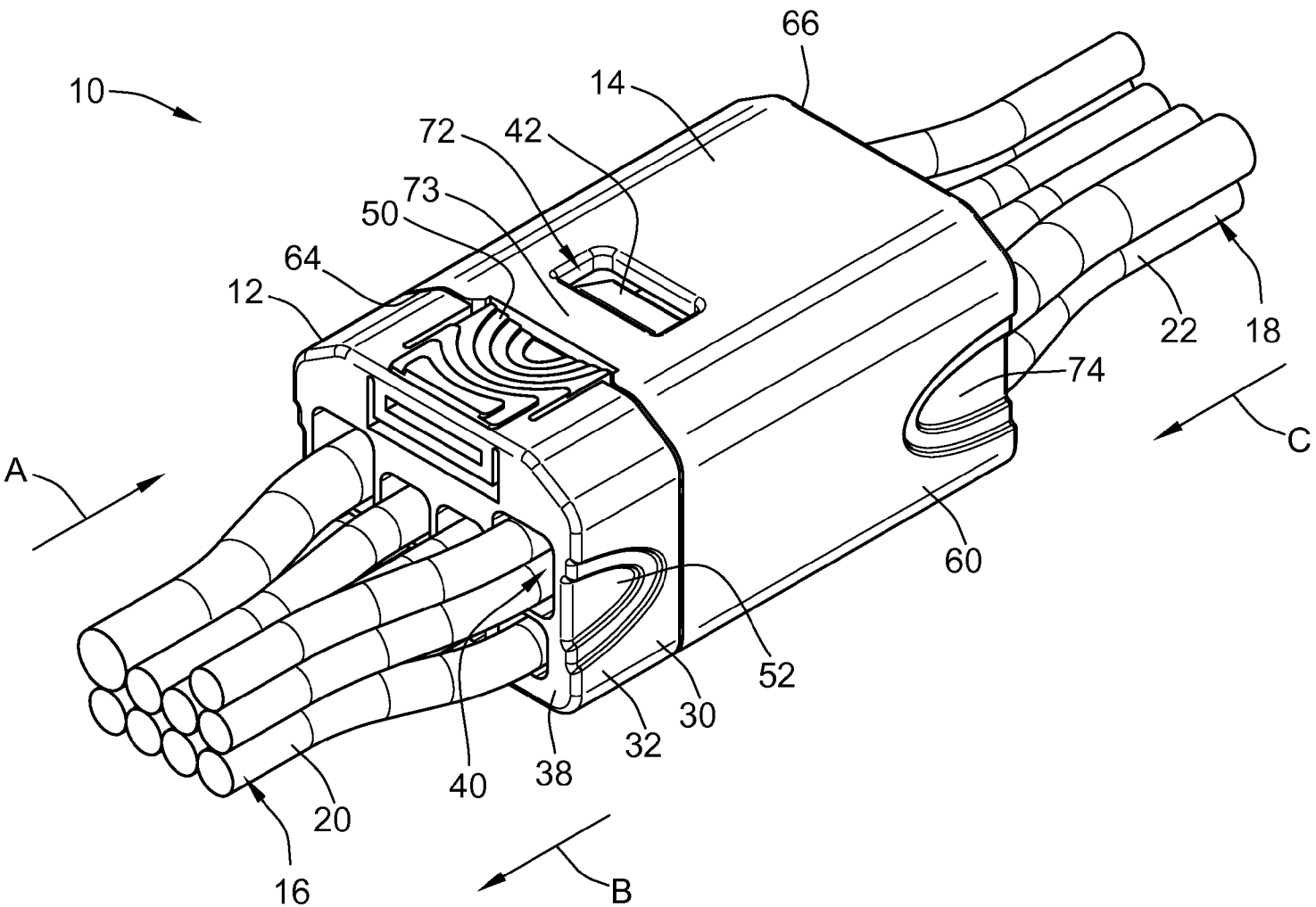
FIG. 1 illustrates an electrical connector assembly having a plug connector and a mating connector formed in accordance with an exemplary embodiment.
Figure 2:
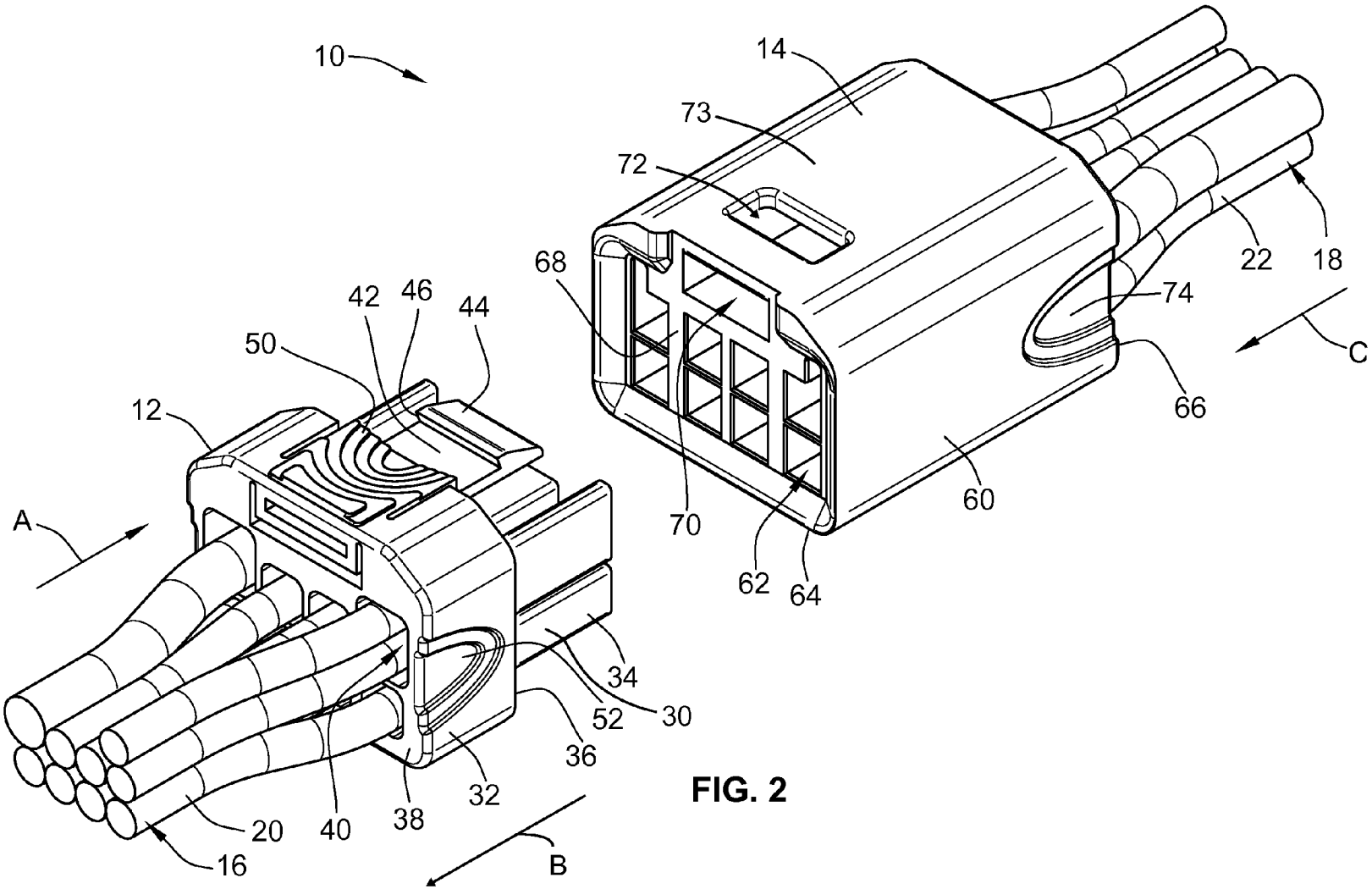
FIG. 2 illustrates the electrical connector assembly shown in FIG. 1 in an unmated state.

FIG. 1 illustrates an electrical connector assembly 10 having a plug connector 12 and a mating connector 14 formed in accordance with an exemplary embodiment. FIG. 2 illustrates the electrical connector assembly 10 in an unmated state. The connectors 12, 14 represent cable connectors terminated at ends of cables 16, 18, respectively. The cables 16, 18 include individual wires 20, 22, respectively, that are routed into the connectors 12, 14. Contacts 24, 26 (shown in FIG. 5) are terminated to ends of the individual wires 20, 22, respectively, and are held within the connectors 12, 14.

The connectors 12, 14 are used to electrically connect the cables 16, 18. The connectors 12, 14 may be used in a variety of different applications. One example of such an application utilizing the connectors 12, 14 is in the appliance industry. For example, the connectors 12, 14 may be used in a refrigerator, however connectors 12, 14 are not limited to use in the appliance industry, and the connectors 12, 14 have application in a wide variety of industries and devices. In an alternative embodiment, one or both of the connectors 12, 14 may be board mounted rather than cable mounted.

The plug connector 12 includes a housing 30 having a base 32 and contact towers 34 (shown in FIG. 2) extending forward from the base 32. The base 32 extends between a front 36 and a rear 38. The wires 20 extend rearward from the rear 38. The contacts 24 and associated wires 20 may be loaded into the base 32 through the rear 38. For example, the base 32 may include contact cavities 40 that extend entirely through the base 32 and into the contact towers 34. The contact cavities 40 are separated from one another and receive individual ones of the contacts 24. Alternatively, the contact cavities 40 may receive one or more contacts 24, depending on the particular application.

The plug connector 12 includes a resilient latch 42 extending forward from the base 32. The latch 42 may be deflectable during mating and unmated with the mating connector 14. In the illustrated embodiment, the latch includes a ramp surface 44 at a front thereof, and a latching surface 46 behind the ramp surface 44. The latch 42 is recessed with respect to the base 32. For example, the latch 42 does not extend beyond (e.g. above or below) an outer perimeter of the base 32.

The plug connector 12 includes a first finger grip 50 and a pair of second finger grips 52. Any number of finger grips 50 and/or 52 may be provided in alternative embodiments. The first finger grip 50 is provided at the front 36 of the base 32. The second finger grips 52 are provided at the rear 38 of the base 32. The finger grips 50, 52 are recessed with respect to the outer perimeter of the base 32. The finger grips 50, 52 provide an area for the user to grip the housing 30 of the plug connector 12 during mating or unmating. In an exemplary embodiment, the first finger grip 50 is tapered in a forward direction and the second finger grips 52 are tapered in a rearward direction. As such, the second finger grips 52 provide a different type of bearing surface for the user to grip the housing 30 than the first finger grip 50. For example, the second finger grips 52 may be configured to allow the user to push the plug connector 12 towards the mating connector 14, such as in the direction of the Arrow A, during mating. In contrast, the first finger grip 50 may be configured to allow the user to pull the plug connector 12 away from the mating connector 14, such as in the direction of Arrow B. In an exemplary embodiment, the first finger grip 50 is aligned with the latch 42. Pushing downward on the first finger grip 50 may deflect the latch 42 so that the user may unlatch the latch 42, such as during unmating.

The mating connector 14 includes a housing 60 having contact chambers 62 (shown in FIG. 2). The housing 60 extends between a front 64 and a rear 66. The contact chambers 62 extend entirely through the housing 60. The contacts 26 and associated wires 22 may be loaded into the housing 60 through the rear 66. The wires 22 extend rearward from the rear 66. The contact chambers 62 also receive corresponding contact towers 34 of the plug connector 12 such that the mating contacts 26 engage the contacts 24 of the plug connector 12. The contact chambers 62 are separated from one another by separating walls 68. The separating walls 68 are positioned between adjacent contact towers 34 when the plug connector 12 and mating connector 14 are coupled together.

The mating connector 14 includes a latch cavity 70 that receives the latch 42 of the plug connector 12 such that the latch 42 is contained within the housing 60 of the mating connector 14. The latch cavity 70 is open at the front 64 and receives the latch 42 through the open front of the latch cavity 70. The mating connector 14 also includes a window 72 that opens through a top 73 of the housing 60 to the latch cavity 70. As illustrated FIG. 1, the latch 42 may be visible within the window 72 when the plug connector 12 and mating connector 14 are coupled together. Optionally, the latch 42 may engage the window 72 in a latching engagement. For example, the latch surface 46 may be received within the window 72 and engage one of the walls of the window 72 when the plug connector 12 and mating connector 14 are coupled together.

The mating connector 14 includes a plurality of finger grips 74. Any number of finger grips 74 may be provided. The finger grips 74 are provided at the rear 66 of the housing 60. The finger grips 74 are recessed with respect to the outer perimeter of the housing 60. The finger grips 74 provide an area for the user to grip the housing 60 of the mating connector 14 during mating or unmating. The finger grips 74 may be configured to allow the user to push the mating connector 14 towards the plug connector 12, such as in the direction of the Arrow C, during mating.

Figure 3:
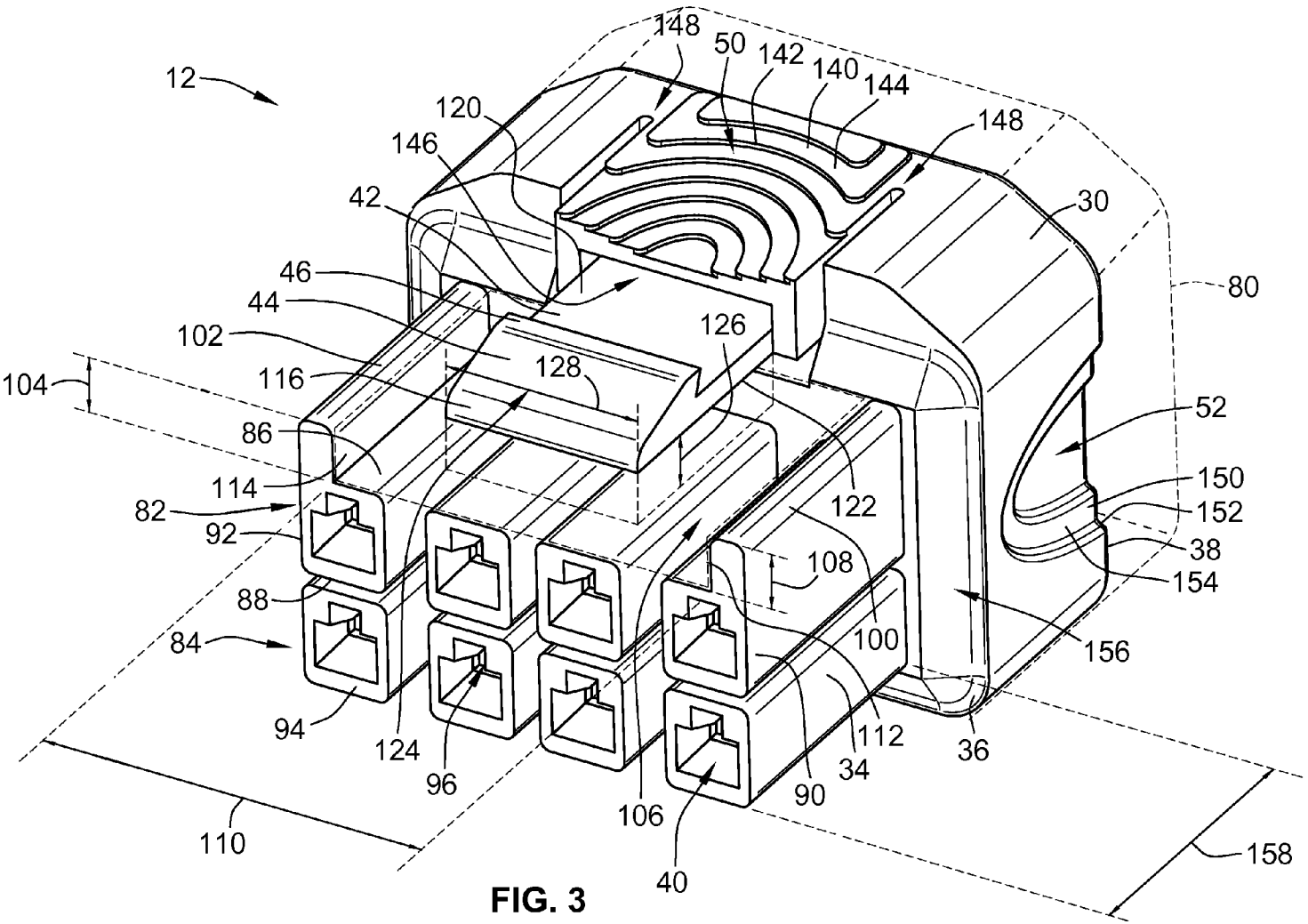
FIG. 3 is a front perspective view of the plug connector shown in FIG. 1.

FIG. 3 is a front perspective view of the plug connector 12. The housing 30 is manufactured from a dielectric material, such as plastic material. Optionally, the housing 30 may be formed by an injection molding process using one or more molds that may be separated from the housing 30 when the housing 30 is formed.

The base 32 defines an outer perimeter 80. In an exemplary embodiment, the outer perimeter 80 of the base 32 is the outermost portion of the plug connector 12. For example, the latch 42 is recessed with respect to the outer perimeter 80. Additionally, the contact towers 34 are recessed with respect to the outer perimeter 80. As such, the plug connector 12 does not include components that extend outward from the base 32, which may make the plug connector 12 easier to handle and route through the appliance or device in which the plug connector 12 is used. For example, the plug connector 12 does not include components that could potentially snag on surfaces or through openings as the plug connector 12 is routed into position.

The contact towers 34 extend forward from the front 36 of the base 32. The contact towers 34 are rectangular in shape, however the contact towers 34 may have other shapes and alternative embodiment. In the illustrated embodiment, the contact towers 34 are arranged in two rows, an upper row 82 and a lower row 84. Four contact towers 34 are included in the upper row 82 and four contact towers 34 are included in the lower row 84, thus defining interior contact towers 34 and exterior contact towers 34, with the exterior contact towers 34 flanking the interior contact towers 34. Any number of different tower configurations (e.g. 1×4, 2×4, 3×3, and the like) may be provided in alternative embodiments.

Each of the contact towers 34 includes a top 86, a bottom 88, and opposed sides 90, 92. The contact cavities 40 extend through the contact towers 34 and are open at a front 94 of the contact towers 34. The contact cavities 40 have chamfered surfaces at the front 94. In the illustrated embodiment, the contact cavities 40 have windows 96 along the top of the contact cavities 40 that are configured to receive a tool to release the contacts 24 (shown in FIG. 5) from the contact cavities 40, as will be described in further detail below.

In an exemplary embodiment, flanges 100, 102 extend outward from the top 86 of two of the contact towers 34. The flanges 100, 102 are provided on the outermost contact towers 34 in the upper row 82. However, the flanges 100, 102 may be provided on other contact towers 34 in alternative embodiments. The flanges 100, 102 are provided on the outermost sides 90, 92, respectively of the contact towers 34. The flanges 100, 102 increase the overall height of the outermost contact towers 34 in the upper row 82. The flanges 100, 102 have a height 104 measured from the top 86. Optionally, the flanges 100, 102 may extend from the front 94 of the contact towers 34 rearward to the base 32. The flanges 100, 102 define a space or void 106 above the tops 86 of each of the contact towers 34 in the upper row 82. The void 106 has a height 108 that is the same as the height 104 of the flanges 100, 102. The void 106 has a width 110 measured between interior surfaces 112, 114 of the flanges 100, 102, respectively. The flanges 100, 102 block the sides of the void 106. For example, the flanges 100, 102 block objects from getting directly above the tops 86 of the contact towers 34. The contact towers 34 extend along a bottom of void 106, the flanges 100, 102 extend along sides of the void 106, and a top of the void 106 is open.

The latch 42 extends forward from the front 36 of the base 32. The latch 42 extends to a distal end 116. The ramp surface 44 extends upward and rearward from a distal end 116. The latching surface 46 is provided rearward of the ramp surface 44. The latching surface 46 is generally rearward facing such that the latching surface 46 faces the base 32. The latch 42 includes a planar top 120 extending rearward from the latching surface 46 to the base 32. The latch 42 includes a planar bottom 122 opposite to the top 120. The planar bottom 122 faces the tops 86 of the contact towers 34. Alternative latch configurations are possible in alternative embodiments.

The latch 42 extends forward from the base 32 such that the bottom 122 is generally parallel to, and spaced apart from, the contact towers 34 such that a gap 124 is defined between a bottom 122 of the latch 42 and the tops 86 of the contact towers 34. In the illustrated embodiment, the latch 42 is centered over, and positioned vertically above, the interior contact towers 34. The latch 42 does not overlay the exterior contact towers 34. The gap 124 has a height 126 measured between the tops 86 of the contact towers 34 and the bottom 122 of the latch 42. The height 126 may be changed, such as when the latch 42 is depressed closer to the contact towers during latching and unlatching. The gap 124 has a width 128 measured between opposed sides 130, 132 of the latch 42. As such, the latch 42 extends along the top of the gap 124, the interior contact towers 34 extend along the bottom of the gap 124, and sides of the gap 124 are open. A portion of the gap 124 overlaps with a portion of the void 106.

The flanges 100, 102 are spaced apart on opposite sides of the gap 124. In an exemplary embodiment, the flanges 100, 102 are offset with respect to the latch 42 such that the flanges 100, 102 are not contained within the gap 124, but rather flank the sides of the gap 124. The flanges 100, 102 at least partially block the gap 124 to restrict access to the gap 124 from sides of the gap 124. As such, the flanges 100, 102 reduce the effective height of the gap 124. For example, the flanges 100, 102 create the void 106, which is an area of dead space. Objects are unable to get into the void 106 through the bottom or the sides, because the contact towers 34 block the bottom and the flanges 100, 102 block the sides of the void 106. Additionally, the latch 42, in effect, indirectly blocks the top of the void 106. Because objects are blocked from getting into the void 106, the effective area of the gap 124 is reduced by the overlapping area of the void 106. As such, the effective height of the gap 124 is reduced, making it more difficult for objects to get between the latch 42 and the contact towers 34. For example, the flanges 100, 102 make it more difficult for wires 20 (shown in FIGS. 1 and 2) to get caught below the latch 42. The latch 42 is thus less susceptible to damage or breakage because the flanges 100, 102 block objects from getting under the latch 42. Additionally, because the flanges 100, 102 are offset and not positioned below the latch 42, the latch 42 retains a full range of motion with respect to the contact towers 34.

In an exemplary embodiment, the flanges 100, 102 operate as keying features for keyed mating with the mating connector 14 (shown in FIGS. 1 and 2). The flanges 100, 102 are configured to orient the plug connector 12 with the mating connector 14.

The finger grips 50, 52 are provided on the base 32. The first finger grip 50 is located at the front 36 of the base 32 and the second finger grips 52 are located at the rear 38 of the base 32. The first finger grip 50 is tapered in a forward direction with the tapered surface facing in the forward direction. The second finger grips 52 are tapered in a rearward direction with the tapered surface facing in the rearward direction.

The first finger grip 50 is stepped inward from the outer perimeter 80. The first finger grip 50 includes a plurality of steps 140 that are stepped downward or inward toward the front 36. Any number of steps 140 may be provided. In an exemplary embodiment, the steps 140 have an elliptical shape. The steps 140 have risers 142 that are forward facing. The steps 140 have runners 144 that extend between adjacent steps 140. A height of the risers 142 and a width of the runners 144 control an angle of taper of the finger grip 50. The first finger grip 50 is tapered in a forward direction to provide a forward facing interference surface that follows the risers 142 and runners 144. The forward facing interface surface is configured to be engaged by a user's finger to pull the housing 30 in a rearward direction.

The housing 30 has an opening 146 interior of the first finger grip 50. The opening 146 allows the first finger grip 50 to flex inward. As the first finger grip 50 flexes inward, the interface surface may be changed. For example, the angle of taper of the finger grip 50 may be increased, which may make it easier for the user to grip the housing 30 and pull the housing 30 rearward. Optionally, the latch 42 may be aligned with and/or extend into the opening 146. As the first finger grip 50 flexes inward, the latch 42 may simultaneously be actuated to an unlatch position. Optionally, slots 148 may be formed in the base 32 on opposite sides of the first finger grip 50 to allow the first finger grip 50 and/or the latch 42 to be pressed inward.

The second finger grips 52 are stepped inward from the outer perimeter 80. The second finger grips 52 include a plurality of steps 150 that are stepped downward or inward toward the rear 38. Any number of steps 150 may be provided. In an exemplary embodiment, the steps 150 have an elliptical shape. The steps 150 have risers 152 that are forward facing. The steps 150 have runners 154 that extend between adjacent steps 150. A height of the risers 152 and a width of the runners 154 control an angle of taper of the finger grips 52. The second finger grips 52 are tapered in a rearward direction to provide a rearward facing interference surface that follows the risers 152 and runners 154. The rearward facing interface surface is configured to be engaged by a user's finger to push the housing 30 in a forward direction.

In an exemplary embodiment, the direction in which the steps 140, 150 of the finger grips 50, 52 are stepped coincide with a direction of the mold pull. For example, the housing 30 may be injection molded using multiple molds that are pulled apart once the housing 30 is molded. By stepping the steps 140, 150 inward from the front 36 and the rear 38, respectively, the various molds may be pulled apart in different directions in such a way that the steps 140, 150 do not block the molds from being pulled apart. As such, simpler molds may be used for the housing 30, which may reduce the overall cost of manufacturing the housing 30.

In an exemplary embodiment, the housing 30 includes a tapered region 156 between the front 36 of the base 32 and the contact towers 34. The tapered region 156 is configured to fit within the mating connector 14 (shown in FIGS. 1 and 2) when the plug connector 12 is coupled thereto. Optionally, a gasket (not shown) may surround or define the tapered region 156 for sealing engagement with the mating connector 14. The contact towers 34 have a length 158 measured between the front 94 and the base 32. The length 158 may be selected based on a length of the contacts 24, 26. For example, the length 158 may be long enough to insure proper alignment of the housing 30 with the mating connector to prevent damage to the contacts 24, 26. The length 158 may be selected to control a condensation weeping path length. For example, as the length 158 is increased, the distance along which condensation would be required to travel to the contacts 24, 26 would also be increased.

Figure 4:
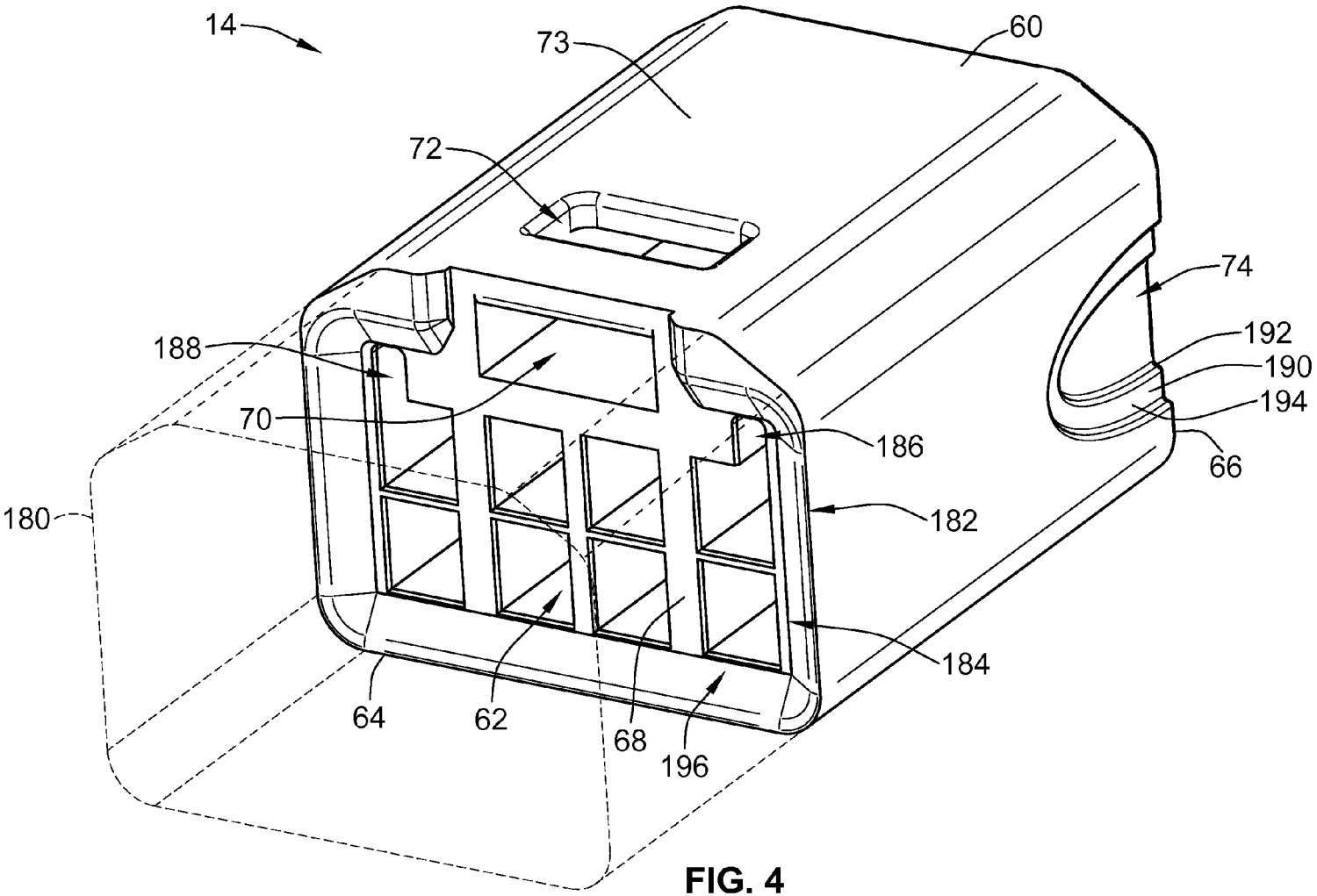
FIG. 4 is a front perspective view of the mating connector shown in FIG. 1.

FIG. 4 is a front perspective view of the mating connector 14. The housing 60 is manufactured from a dielectric material, such as plastic material. Optionally, the housing 60 may be formed by an injection molding process using one or more molds that may be separated from the housing 60 when the housing 60 is formed.

The housing 60 defines an outer perimeter 180. In an exemplary embodiment, the outer perimeter 180 is the outermost portion of the mating connector 14. The contact chambers 62 are recessed with respect to the outer perimeter 180. As such, the mating connector 14 does not include components that extend outward from the housing 60, which may make the mating connector 14 easier to handle and route through the appliance or device in which the mating connector 14 is used. For example, the plug connector 12 does not include components that could potentially snag on surfaces or through openings as the mating connector 14 is routed into position.

The contact chambers 62 are rectangular shape, however the contact chambers 62 may have other shapes and alternative embodiment. The separating walls 68 separate adjacent contact chambers 62. In the illustrated embodiment, the contact chambers 62 are arranged in two rows, an upper row 182 and a lower row 184. One of the separating walls 68 is provided between the upper and lower rows 182, 184. Four contact chambers 62 are included in the upper row 182 and four contact chambers 62 are included in the lower row 184. In an exemplary embodiment, grooves 186, 188 extend outward from the contact chambers of the outermost contact chambers 62 in the upper row 182. The grooves 186, 188 have a complementary size and shape to the flanges 100, 102 (shown in FIG. 3). The grooves 186, 188 receive the flanges 100, 102 when the plug connector 12 and mating connector 14 are coupled together.

The latch cavity 70 is open at the front 64 and is configured to receive the latch 42 (shown in FIG. 3). Optionally, at least a portion of the latch 42 is configured to be received within the window 72 when the plug connector 12 and the mating connector 14 are coupled together.

The finger grips 74 are provided on the housing 60. The first finger grips 74 are located at the rear 66. The finger grips 74 are tapered in a rearward direction with the tapered surface facing in the rearward direction. The finger grips 74 are stepped inward from the outer perimeter 180. The finger grips 74 include a plurality of steps 190 that are stepped downward or inward toward the rear 66. Any number of steps 190 may be provided. In an exemplary embodiment, the steps 190 have an elliptical shape. The steps 190 have risers 192 that are rearward facing. The steps 190 have runners 194 that extend between adjacent steps 190. A height of the risers 192 and a width of the runners 194 control an angle of taper of the finger grips 74. The finger grips 74 are tapered in a rearward direction to provide a rearward facing interference surface that follows the risers 192 and runners 194. The rearward facing interface surface is configured to be engaged by a user's finger to push the housing 60 in a forward direction.

In an exemplary embodiment, the direction in which the steps 190 of the finger grips 74 are stepped coincide with a direction of the mold pull. For example, the housing 60 may be injection molded using multiple molds that are pulled apart once the housing 60 is molded. By stepping the steps 190 inward from the rear 66, the various molds may be pulled apart in different directions in such a way that the steps 190 do not block the molds from being pulled apart. As such, simpler molds may be used for the housing 60, which may reduce the overall cost of manufacturing the housing 60.

In an exemplary embodiment, the housing 60 includes a chamfered lead-in 196 at the front 64. The lead-in 196 is configured to guide the contact towers 34 (shown in FIG. 3) into the contact chambers 62 when the plug connector 12 is coupled to the mating connector 14. Optionally, a gasket (not shown) may surround the lead-in 196 for sealing engagement with the plug connector 12.

Figure 5:
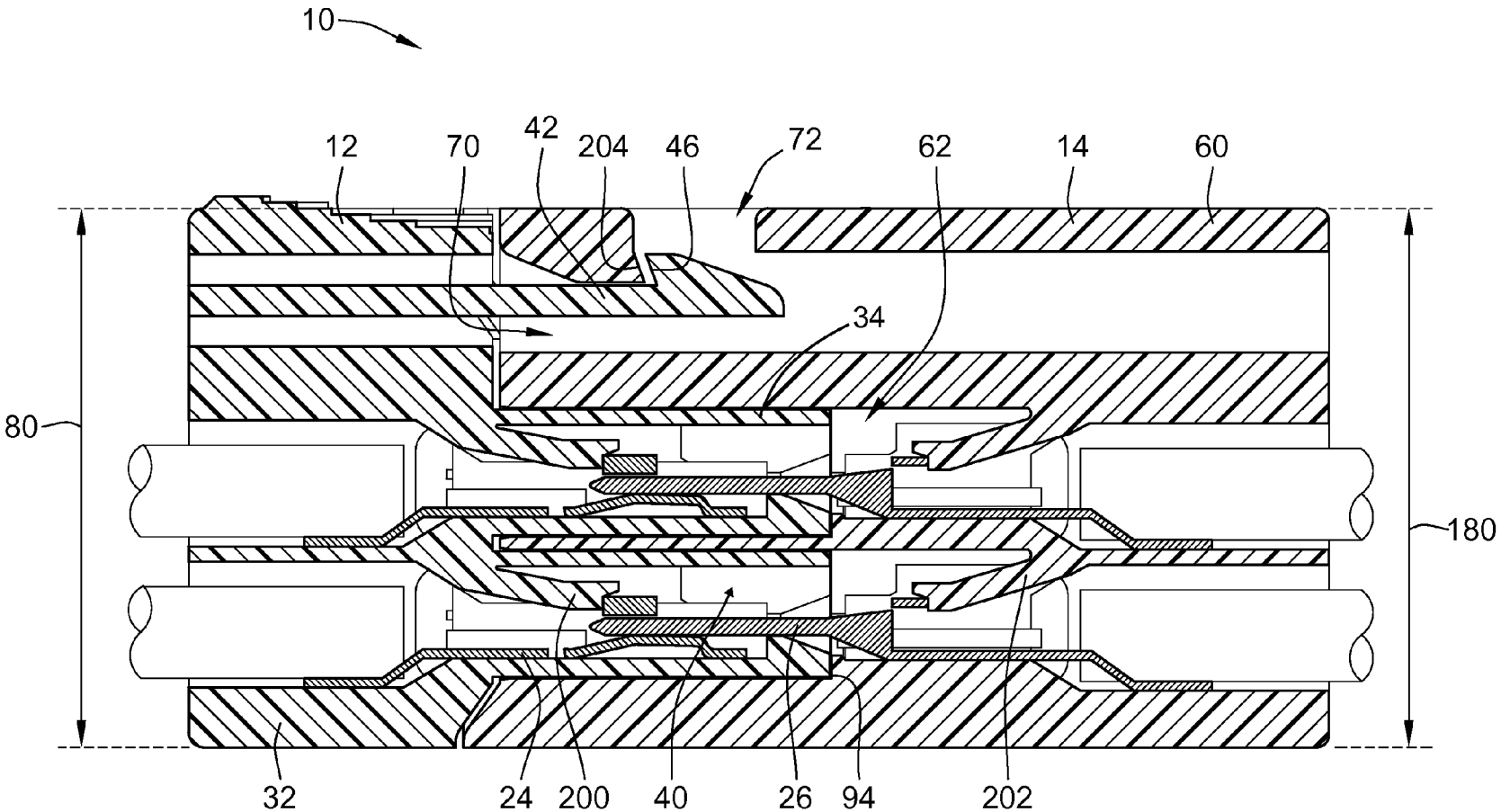
FIG. 5 is a cross-sectional view of the electrical connector assembly shown in FIG. 1.

FIG. 5 is a cross-sectional view of the electrical connector assembly 10 in an assembled state. The plug connector 12 is coupled to the mating connector 14. During mating, the contact towers 34 are loaded into the contact chambers 62. During mating, the latch 42 is received in the latch cavity 70 to securely couple the plug connector 12 to the mating connector 14.

The contacts 24 are held within the contact cavities 40 and the contacts 26 are held within the contact chambers 62. The contacts 24 engage the contacts 26 when the plug connector 12 is coupled to the mating connector 14. An electrical connection is made therebetween. In the illustrated embodiment, the contact 24 represents a socket contact and the contact 26 represents a pin contact. The pin contact 26 is loaded into the corresponding contact cavity 40 to mate with the corresponding socket contact 24. Optionally, the contact cavities 40 may be chamfered at the front 94. A latch 200 extends into the contact cavities 40 to hold the contact 24 within the contact cavities 40. Similarly, a latch 202 extends into the contact chamber 62 to hold the contact 26 within the contact chamber 62. The latches 200, 202 may be released by a special tool. For example, the tool may be loaded into the contact cavity 40 through the window 96 in the front 94. Similarly, the tool may be loaded into the contact chamber 62 through the front 64.

When mated, the latch 42 securely couples the plug connector 12 to the mating connector 14. For example, the latching surface 46 engages a corresponding latching surface 204 within the latch cavity 70. The latching surface 204 is positioned below the window 72 so that the user is able to visually determine if the latch 42 is properly position. Optionally, the latching surface 204 may be angled such that the latching surface 204 may be readily observed by the user through the window 72. In an alternative embodiment, the latching surface 204 may be defined by one of the walls defining the window 72. As such, the latch 42 may extend at least partially into the window 72.

In the assembled state, the electrical connector assembly 10 has a generally smooth outer surface. For example, the outer perimeter 80 of the base 32 is substantially the same as the outer perimeter 180 of the housing 60. When mated, the housing 60 is positioned adjacent to the base 32 such that the electrical connector assembly 10 has a smooth and continuous outer surface. The latch 42 is recessed below the outer perimeters 80, 180 such that the latch 42 is positioned internal to the housing 60. When mated, the housing 60 completely circumferentially surrounds the latch 42 and the contact towers 34. As such, neither the latch 42 nor the contact towers 34 are exposed externally.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector assembly comprising:

a housing having a base and contact towers extending forward from the base, the base having an outer perimeter defined between a front and a rear of the base, the base having a latch extending forward from the base generally parallel to and spaced apart from the towers such that a gap is defined between a bottom of the latch and a top of the towers;

flanges extending upward from the top of the towers to free ends of the flanges, the free ends being configured to be covered by a housing of a mating connector, the flanges at least partially blocking the gap; and contacts held by the housing, the contacts extending into the contact towers for mating with mating contacts of the mating connector; wherein each flange has an inner side and an outer side extending between the corresponding contact tower and the free end, the inner sides of the flanges facing one another, the outer sides of the flange facing away from one another, the gap being open between the inner sides, the flanges restrict access to the gap between the inner from sides.

2. The electrical connector assembly of claim 1, wherein the flanges are spaced apart on opposite sides of the gap, the flanges being offset from the latch.

3. The electrical connector assembly of claim 1, wherein the flanges extend upward from the top of the towers to the free ends to reduce the gap, the free ends being substantially aligned with the bottom of the latch.

4. The electrical connector assembly of claim 1, wherein the towers have a first side and a second side, the flanges being positioned on the first side and the second side, respectively.

5. The electrical connector assembly of claim 1, wherein the flanges prevent objects sized to fit in the gap from getting into the gap by blocking the gap from opposite sides of the gap.

6. The electrical connector assembly of claim 1, wherein the latch is deflectable toward the towers, the flanges being offset with respect to latch.

7. An electrical connector assembly comprising:

a housing having a base and contact towers extending forward from the base, the base having sides that define outer surfaces defining an outer perimeter of the base that extends between a front and a rear of the base, the base having a latch extending forward from the base for latching engagement with a mating connector, the base having a first finger grip and a second finger grip, the first finger grip being tapered into the base such that the first finger grip is slanted with respect to the outer surface in a forward direction, the second finger grip being tapered into the base such that the second finger grip is slanted with respect to the outer surface in a rearward direction; and contacts held by the housing, the contacts extending into the contact towers for mating with mating contacts of the mating connector;

flanges extending upward from a top of the towers, each flange has an inner side and an outer side extending between the corresponding contact tower and a free end, the inner sides of the flanges facing one another, the outer sides of the flange facing away from one another, the gap being open between the inner sides, the flanges restrict access to the gap between the inner from sides.

8. The electrical connector assembly of claim 7, wherein the first finger grip is located at the front and the second finger grip is located at the rear.

9. The electrical connector assembly of claim 7, wherein the first and second finger grips are stepped inward from the outer surface, the first finger grip being stepped downward and angled with respect to the outer surface toward the front, the second finger grip being stepped downward and angled with respect to the outer surface toward the rear.

10. The electrical connector assembly of claim 7, wherein the first and second finger grips each have a plurality of steps that are successively stepped further inward into the base such that the steps are at different depths from the outer surface, the steps being elliptical in shape.

11. The electrical connector assembly of claim 7, wherein the first and second finger grips each have a plurality of steps that are at different depths from the outer surface, the steps having risers, the risers of the first finger grip facing the front, the risers of the second finger grip facing the rear.

12. The electrical connector assembly of claim 7, wherein the housing has an opening interior of the finger grips, the opening allowing the first finger grip to flex inward.

13. The electrical connector assembly of claim 7, wherein the first finger grip is tapered in a forward direction to provide a forward facing interference surface being configured to be engaged by a user's finger to pull the housing in a rearward direction, the second finger grip being tapered in a rearward direction to provide a rearward facing interference surface being configured to be engaged by a user's finger to push the housing in a forward direction.

14. An electrical connector assembly comprising:

a plug connector having a housing having a base and contact towers extending forward from the base, the base receiving contacts therein that extend at least partially into the contact towers, the base having an outer perimeter defined between a front and a rear of the base, the base having a latch extending forward from the base, the latch being recessed with respect to the outer perimeter of the base; and a mating connector having a housing having contact chambers extending between a front and a rear of the housing, the housing having a top, a bottom and sides extending between the top and the bottom, the contact chambers receiving mating contacts therein and the contact chambers receiving the contact towers of the plug connector such that the mating contacts engage the contacts of the plug connector, the housing having a an interior latch cavity enclosed by the housing, the latch cavity receiving the latch of the plug connector such that a portion of the housing of the mating connector covers the latch and the latch is contained within the housing of the mating connector;

flanges extending upward from a top of the towers, each flange has an inner side and an outer side extending between the corresponding contact tower and the free end, the inner sides of the flanges facing one another, the outer sides of the flange facing away from one another, the gap being open between the inner sides, the flanges restrict access to the gap between the inner from sides.

15. The electrical connector assembly of claim 14, wherein the latch extends forward from the base generally parallel to and spaced apart from the contact towers such that a gap is defined between a bottom of the latch and a top of the towers, at least two of the contact towers having flanges extending upward from the top of the towers to free ends, the flanges at least partially blocking the gap, the plug connector being plugged into the mating connector such that the free ends engage the housing of the mating connector.

16. The electrical connector assembly of claim 14, wherein the base includes a first finger grip and a second finger grip, the first finger grip being tapered into the base such that the first finger grip is slanted with respect to an outer surface of the base of the plug connector in a forward direction, the second finger grip being tapered into the base such that the first finger grip is slanted with respect to the outer surface of the base of the plug connector in a rearward direction.

17. The electrical connector assembly of claim 14, wherein the contact towers are separate from one another, the contact chambers being defined by separating walls, the separating walls being positioned between adjacent contact towers when the plug connector and mating connector are coupled together.

18. The electrical connector assembly of claim 14, wherein the front of the housing of the mating connector has a chamfered lead-in surface configured to direct the contact towers into the contact chambers.

19. The electrical connector assembly of claim 14, wherein the housing of the mating connector includes a window in a the top of the housing open to the latch cavity and being entirely surrounded by the housing, the latch being secured within the latch cavity such that the latch is visible through the window and a portion of the latch extends into the window to engage the housing of the mating connector.

* * * * *